US006546897B1

(12) United States Patent
Edds et al.

(10) Patent No.: US 6,546,897 B1
(45) Date of Patent: Apr. 15, 2003

(54) THERMODYNAMICALLY ACTIVATED FLUE DAMPER

(75) Inventors: Thomas A. Edds, Jonesborough, TN (US); Allen W. Scott, Jonesborough, TN (US)

(73) Assignee: American Water Heater Company, Johnson City, TN (US)

( * ) Notice: Subject to any disclaimer, the term of this patent is extended or adjusted under 35 U.S.C. 154(b) by 0 days.

(21) Appl. No.: 10/078,747

(22) Filed: Feb. 19, 2002

(51) Int. Cl.[7] ..... F22B 9/18

(52) U.S. Cl. ..... 122/44.2; 122/155.2; 110/163; 126/285 R; 126/287.5; 126/293

(58) Field of Search ..... 122/13.01, 15.1, 122/18.3, 44.2, 135.1, 155.2, 235.17, 451.1, 479.5, 503; 110/163; 126/285 R, 287.5, 293

(56) References Cited

U.S. PATENT DOCUMENTS 3,897,773 A * 8/1975 Burt et al. ..... 110/163
4,046,318 A * 9/1977 Ripley ..... 110/153
4,236,668 A 12/1980 Prikkel, III
4,283,006 A 8/1981 Fedewitz
4,290,552 A * 9/1981 Prikkel, III ..... 110/163
4,408,567 A * 10/1983 Morton ..... 126/285 R
4,441,653 A 4/1984 Grudich
4,460,121 A 7/1984 Hedrick
4,838,481 A 6/1989 Diermayer et al.
4,953,510 A * 9/1990 Akkala et al. ..... 122/44.2
5,071,064 A 12/1991 Abujudom, II et al.
5,186,385 A 2/1993 Karabin et al.
5,695,116 A 12/1997 Karabin

* cited by examiner

*Primary Examiner*—Gregory Wilson
(74) *Attorney, Agent, or Firm*—Schnader Harrison Segal & Lewis, LLP

(57) ABSTRACT

The invention is directed to a thermodynamically activated flue damper for a gas water heater that includes a flue damper for controlling the passage of exhaust gases through the flue; and a thermally sensitive member that is capable of contracting when the exhaust gasses in the flue heat the thermally sensitive member to its transition temperature and expanding when the temperature of the thermally sensitive material falls below its transition temperature. The thermally sensitive member is connected between the flue damper and a support member in the flue to control the pivoting of the flue damper as the thermally sensitive metal expands or contracts at the transition temperature. The flue damper system may also include a counter-balancing member to provide a counter-balancing force to the said thermally sensitive metal, such as a coil spring. The thermally sensitive member may be formed in the shape such as a rod, a wire, and an elongated bar, and may be made from Nytinol or other similar metals.

20 Claims, 2 Drawing Sheets

THERMODYNAMICALLY ACTIVATED FLUE DAMPER

FIELD OF THE INVENTION

This invention relates to a gas water heater. More particularly, the invention relates to a thermodynamically activated flue damper for a gas water heater. Even more particularly, the invention relates to the use of thermally sensitive material to activate the flue damper of a gas water heater.

DESCRIPTION OF THE PRIOR ART

Historically, the energy efficiency of gas water heaters has been limited by the use of an open flue tube design. Heat energy is extracted in these systems from the hot water by the air that is drafted up the open flue tube. The loss of thermal energy attributable to the flue draft typically accounts for 50% or more of the total energy loss during the off cycle phase of water heater operation.

It has long been known that closing the flue in a gas water heater when the burner is in its off cycle will help to minimize the energy losses described above. This has been addressed in the systems of the prior art through the use of a damper or other flue-obstructing device. An electric motor or solenoid is typically used as an engine, and is controlled by an electrical or electronic logic system.

However, these systems have the significant disadvantages that they require a complicated sensing and control system to operate the damper and that they require a source of electricity to power the unit. Consequently, these systems are expensive to manufacture, are often unreliable, and will not operate if there is a loss of power.

It has generally been known in the prior art to utilize thermally responsive materials to operate a damper. For example, examples of standard vent dampers that utilize thermally responsive materials are disclosed in U.S. Pat. Nos. 4,838,481; 4,460,121; and 4,236,668. However, because of important safety concerns in the operation of gas water heaters, the American National Standard Institute (ANSI) has strict regulations on the design and operation of both flue dampers and vent dampers, which have very different operational concerns. For example, ANSI Rule 1.27.10 requires that vent dampers assume their open position in the event of motive power failure, unless interlocked with the gas ignition system to prevent its operation when the damper is not fully open.

Unfortunately, these vent dampers are not usable within the flue of a gas water heater, since they do not satisfy the aforementioned regulations for flue dampers, such as their ability to be removed for cleaning.

Vent dampers utilizing thermally responsive materials are also known in the art. One example of such a system of the prior art is disclosed in U.S. Pat. No. 5,186,385. As disclosed therein, a hinged damper is attached to bimetallic springs, which operate the damper as hot air enters the vent. Similar bi-valve vent systems are also disclosed in U.S. Pat. Nos. 5,695,116 and 4,441,653.

However, these systems have the distinct disadvantage that they cannot be used in the flue of gas water heaters, because of the significant flue obstruction caused by the bi-valve design. These hinged devices must also be fastened to the wall of the flue, which prevents their removal for the cleaning of water heater flue, as required by the aforementioned regulations. Moreover, the conventional bimetallic strips used in these systems cannot stand up to the corrosive elements present in the hot flue gases of today's gas water heaters.

Accordingly, a system of minimal complexity and maximum reliability is needed for reducing thermal losses through the flue of a gas water heater without the use of electrical or electronic control systems, and which complies with the specific safety requirements of gas water heaters.

SUMMARY OF THE INVENTION

The invention is directed to a flue damper system for controlling the passage of exhaust gases through the flue of a gas water heater with a thermally responsive material in conjunction with a pivoting flue damper that is mounted to a support member within the flue of the gas water heater. The thermally sensitive member is connected between the flue damper and the support member in the flue to control the pivoting of the flue damper as the thermally sensitive metal expands or contracts at the transition temperature. The flue damper system may also include a counter-balancing member to provide a counter-balancing force to the thermally sensitive metal, such as a coil spring. The thermally sensitive member may be formed in the shape of one or more from the group consisting of a rod, a wire, and an elongated bar, and may comprise Nytinol or other similar metal alloys.

DETAILED DESCRIPTION

The invention will be understood more fully from the detailed description given below and from the accompanying drawings of preferred embodiments of the invention; which, however, should not be taken to limit the invention to a specific embodiment but are for explanation and understanding only.

Figure 1:
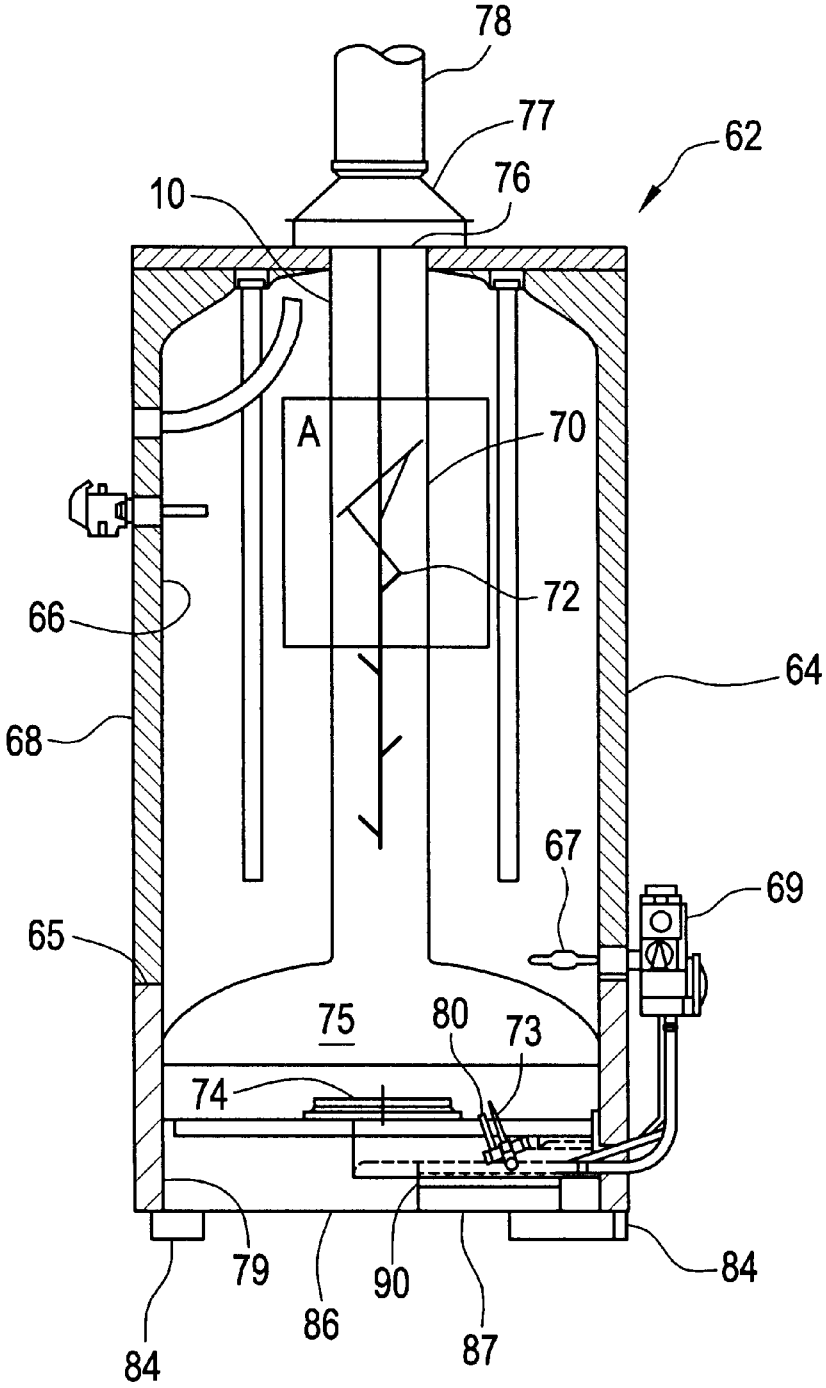
FIG. 1 is a cross section illustrating a gas water heater incorporating the preferred embodiment of the invention.

Turning now FIG. 1, there is illustrated a storage type gas water heater 62 including jacket 64 which surrounds a water tank 66 and a main burner 74 in an enclosed chamber 75. Water tank 66 is preferably capable of holding heated water at mains pressure and is insulated preferably by foam insulation 68. Alternative insulation may include fiberglass or other types of fibrous insulation and the like. Fiberglass insulation surrounds chamber 75 at the lowermost portion of water tank 66. It is possible that heat resistant foam insulation can be used if desired. A foam dam 67 separates foam insulation 68 and the fiberglass insulation.

Located underneath water tank 66 is a pilot burner 73 and main burner 74, which preferably use natural gas as their fuel or other gases such as LPG, for example. Other suitable fuels may be substituted. Burners 73 and 74 combust gas admixed with air and the hot products of combustion resulting rise up through flue 70, possibly with heated air. Water tank 66 is preferably lined with a glass coating for corrosion resistance. Also, the lower portion of flue 70 exposed to flue gases is coated to prevent scaling that could fall into chamber 75 and possibly partially block off air inlet plate 90. The thickness of the coating is about one half of the thickness of the interior facing surface.

The fuel gas is supplied to both burners (73, 74) through a gas valve 69. Flue 70, in this instance, contains a series of baffles 72 to better transfer heat generated by main burner 74 to water within tank 66. Near pilot burner 73 is a flame detecting thermocouple 80, which is a known safety measure to ensure that in the absence of a flame at pilot burner 73 the gas control valve 69 shuts off the gas supply. The water temperature sensor 67, preferably located inside the tank 66, co-operates also with the gas control valve 69 to supply gas to the main burner 74 on demand.

The products of combustion pass upwardly and out the top of jacket 64 via flue outlet 76 after heat has been transferred from the products of combustion. Flue outlet 76 discharges conventionally into a draft diverter 77, which in turn connects to exhaust duct 78 leading outdoors.

Water heater 62 is mounted preferably on legs 84 to raise the base 86 of the combustion chamber 75 off the floor. In base 86 is an aperture 87, which is closed gas tightly by air inlet plate 90, which admits air for the combustion of the fuel gas combusted through the main burner 74 and pilot burner 73, regardless of the relative proportions of primary and secondary combustion air used by each burner. Air inlet plate 90 is preferably made from a thin perforated sheet, preferably stainless steel.

Where base 86 meets the vertical combustion chamber walls 79, adjoining surfaces can be either one piece or alternatively sealed to prevent ingress of air or flammable extraneous fumes. Gas, water, electrical, control or other connections, fittings or plumbing, wherever they pass through combustion chamber wall 79, are sealed. The combustion chamber 75 is air/gas tight except for means to supply combustion air and to exhaust combustion products through flue 70.

A pilot flame can be established using a piezoelectric igniter. A pilot flame observation window can be provided which is sealed. Cold water is introduced at a low level of the tank 66 and withdrawn from a high level in any manner as already well known.

During normal operation, water heater 62 operates in substantially the same fashion as conventional water heaters except that air for combustion enters through air inlet plate 90. However, if spilled fuel or other flammable fluid is in the vicinity of water heater 62, then some extraneous fumes from the spilled substance may be drawn through plate 90 by virtue of the natural draft characteristic of such water heaters. Air inlet 90 allows the combustible extraneous fumes and air to enter, but confines potential ignition and combustion inside the combustion chamber 75.

The spilled substance is burned within combustion chamber 75 and exhausted through flue 70 via outlet 76 and duct 78. Because the flame is confined within the combustion chamber by the air inlet plate 90, flammable substance(s) external to water heater 62 will not be ignited. The air inlet has mounted on or adjacent its upward facing surface a thermally sensitive fuse in series in an electrical circuit with pilot flame proving thermocouple 80 and a solenoid coil in gas valve 69.

Figure 2:
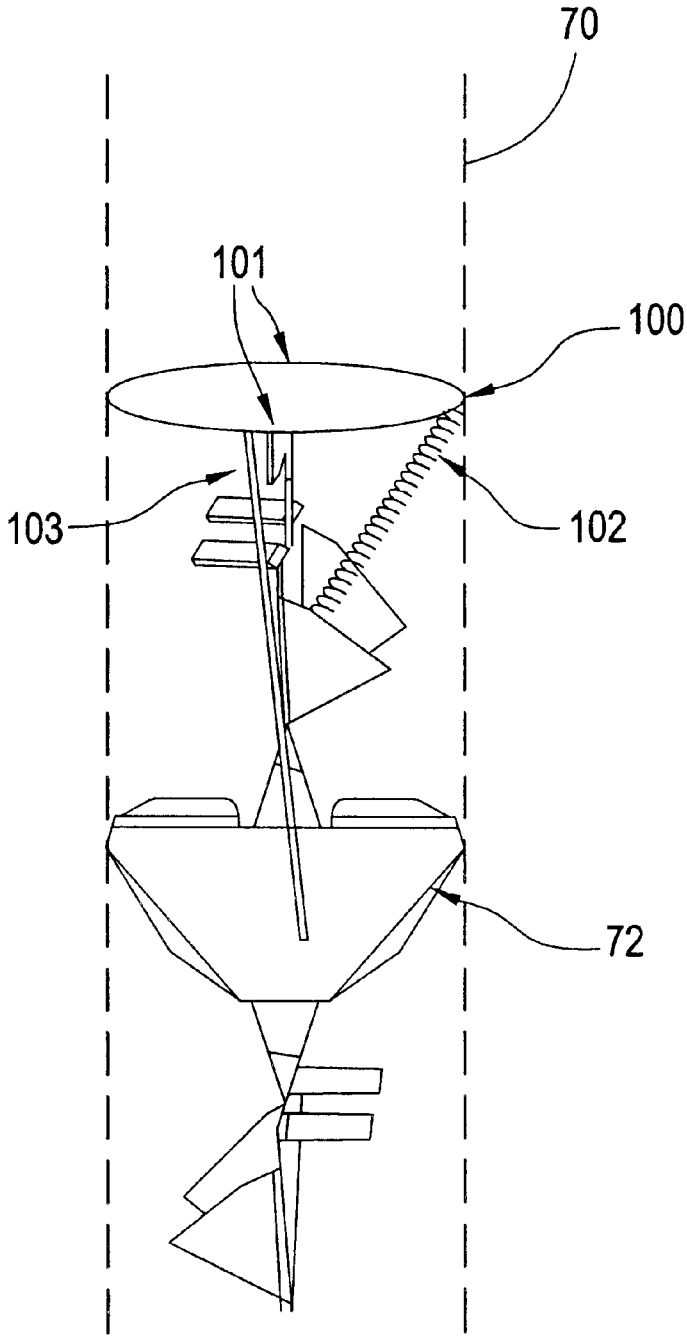
FIG. 2 is an exploded view of section "A" of FIG. 1 illustrating the preferred embodiment of the flue damper of the invention.

FIG. 2 is an exploded view of a portion of flue 70, illustrating the operation of the flue damper of the invention. As shown in FIG. 2, flue 70 may contain flue damper 100, which, in the preferred embodiment, is a metal plate centrally mounted on pivots 101 on flue baffle 72, so that it may freely rotate from a substantially horizontal and substantially closed position, which prevents the escape of heated air/flue gases through flue 70, to an angled, substantially open position during the operation of the burner as described above.

A counter-balancing member 102, such as coil spring or similar device, may preferably be attached from one end of flue damper 100 to a support member within flue 70, such as one of flue baffles 72. Counter-balancing member 102 provides a counter-balancing force that acts to hold flue damper 100 in its substantially horizontal and closed position, when the burner is not in operation, thereby preventing heated exhaust air/flue gases from escaping through flue 70, and consequently, reducing the thermal loss of the water heater.

In accordance with the invention, a thermally sensitive member 103 may be attached from an opposing end portion of flue damper 100 to a support member within flue 70, such as one of flue baffles 72. Thermally sensitive member 103 is preferably formed as a wire but may also be formed as a rod, elongated bar, or other, more rigid connective device, for additional rigidity, particularly in the absence of counter-balancing member 102. Thermally sensitive member 103 may comprise a number of materials, such as so-called a "memory metal" or Nytinol, produced under a number of brand names, such as Flexinol™. These metals are preferred because they have the distinct property that they undergo a molecular change in structure as they reach their transition temperature, which has the effect of reducing their length when heated above the transition temperature (and, conversely, expanding their length as the metal cools back below the transition temperature).

When the burner is off, counter-balancing member 102 holds flue damper 100 substantially closed, preventing heated exhaust air (having a temperature below the transition temperature of the metal of thermally sensitive member 103) from escaping through flue 70. When the burner is ignited, however, the exhaust air in flue 70 begins to heat up, quickly reaching the transition temperature of thermally sensitive member 103. Once the temperature of the exhaust air in flue 70 rises above the transition temperature, thermally sensitive member 103 contracts, forcing flue damper 100 to pivot open against the force of counter-balancing member 102.

Conversely, when the burner is again turned off, the air in flue 70 cools somewhat until it falls below the transition temperature of thermally sensitive member 103. At this point, because thermally sensitive member 103 is a memory metal, it expands back to its original length, as counter-balancing member 102 pulls flue damper 100 substantially closed, once again preventing the escape of the heated exhaust air/flue gases through flue 70.

In one alterative embodiment, thermally sensitive member 103 is connected to flue damper 100 such that it can control the opening and closing of flue damper 100 without the need for counter-balancing member 102. For example, thermally sensitive member 103 may be connected along an edge of flue damper 100 so that the weight of flue damper 100 itself (which may be made heavier on one side) acts as a counter-balancing member. Moreover, if thermally sensitive member 103 is made sufficiently rigid, then its expansion below the transistor temperature may act to close flue damper 100.

Although this invention has been described with reference to particular embodiments, it will be appreciated that many variations may be resorted to without departing from the spirit and scope of this invention.

What is claimed is:

1. A thermodynamically activated flue damper system for a gas water heater comprising:

a flue damper for controlling the passage of exhaust gases through said flue, said flue damper being pivotally mounted within said flue; and a thermally sensitive member, said thermally sensitive member being capable of contracting when said exhaust gases in said flue heat, said thermally sensitive member to its transition temperature and expanding when the temperature of said thermally sensitive member falls below its transitions temperature;

wherein said thermally sensitive member is connected between said flue damper and a top end of a flue baffle in said flue to control pivoting of said flue damper as said thermally sensitive member expands or contracts.

2. The flue damper system of claim 1, wherein said flue damper comprises a metal plate.

3. The flue damper system of claim 1, wherein said thermally sensitive member is formed in a shape selected from the group consisting of rod, wire, and elongated bar.

4. The flue damper system of claim 1, wherein said thermally sensitive member comprises a metal alloy.

5. A thermodynamically activated flue damper system for a gas water heater comprising:

a flue damper for controlling the passage of exhaust gases through said flue, said flue damper being pivotally mounted within said flue;

a thermally sensitive member connected between said flue damper and a member in said flue to control pivoting of said flue damper as said thermally sensitive member expands or contracts, said thermally sensitive member being capable of contracting when said exhaust gases in said flue, heat said thermally sensitive member to its transition temperature and expanding when the temperature of said thermally sensitive member falls below its transitions temperature; and a counter-balancing member to provide a counter-balancing force to said thermally sensitive member.

6. The flue damper system of claim 5, wherein said counter-balancing member is connected to said flue damper and said member.

7. The flue damper system of claim 5, wherein said counter-balancing member comprises a coil spring connected to provide a counter-balancing force to said thermally sensitive member.

8. The flue damper of claim 5, wherein said member comprises a flue baffle.

9. A flue damper system for controlling the passage of exhaust gases through a flue of a gas water heater comprising:

a flue damper, said flue damper being pivotally attached to said flue;

a thermally sensitive member capable of contracting when said exhaust gases in said flue heat said thermally sensitive member to its transition temperature and contracting when the temperature of said thermally sensitive member drops below said transition temperature, wherein said thermally sensitive member is connected between said flue damper and a member in said flue to control the movement of said flue damper by contraction or expansion of said thermally sensitive member above and below said transition temperature; and a counter-balancing member connected to provide a counter-balancing force to said thermally sensitive member.

10. The flue damper system of claim 9, wherein said counter-balancing member is connected to said flue damper and said support member.

11. The flue damper system of claim 9, wherein said counter-balancing member comprises a coil spring.

12. The flue damper system of claim 9, wherein said flue damper comprises a metal plate.

13. The flue damper system of claim 9, wherein said thermally sensitive member is formed in a shape of selected from the group consisting of rod, wire, and elongated bar.

14. The flue damper of claim 9, wherein said support member comprises a flue baffle.

15. The flue damper system of claim 9, wherein said thermally sensitive member comprises a metal alloy.

16. A flue damper system for controlling the passage of exhaust gases through a flue of a gas water heater comprising:

a flue damper plate, said flue damper plate being pivotally mounted within said flue;

an elongated thermally sensitive member, said thermally sensitive member having a transition temperature above which said thermally sensitive member contracts and below which said thermally sensitive member expands, said elongated thermally sensitive member being connected between said flue damper plate and a member in said flue such that said thermally sensitive member is capable of controlling movement of said flue damper plate when said thermally sensitive member contracts and expands above and below said transition temperature due to heat of said exhaust gases; and a counter-balancing spring, said counter-balancing spring being connected to provide a counter-balancing force to said thermally sensitive member.

17. The flue damper system of claim 16, wherein said counter-balancing spring is connected to said flue damper and said member.

18. The flue damper of claim 16, wherein said member comprises a flue baffle.

19. The flue damper system of claim 16, wherein said elongated thermally sensitive member is formed in a shape selected from the group consisting of rod, wire, and elongated bar.

20. The flue damper system of claim 16, wherein said thermally sensitive member comprises Nytinol.

* * * * *